US008396404B2

(12) United States Patent
Tabb et al.

(10) Patent No.: US 8,396,404 B2
(45) Date of Patent: Mar. 12, 2013

(54) IMAGE TRANSFER NIP METHOD AND APPARATUS USING CONSTANT CURRENT CONTROLS

(75) Inventors: Charles H. Tabb, Penfield, NY (US); Christopher A. DiRubio, Webster, NY (US); John T. Buzzelli, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 110 days.

(21) Appl. No.: 12/868,977

(22) Filed: Aug. 26, 2010

(65) Prior Publication Data

US 2012/0051801 A1 Mar. 1, 2012

(51) Int. Cl.
*G03G 15/01* (2006.01)

(52) U.S. Cl. ..... 399/302

(58) Field of Classification Search ..... 399/66, 399/101, 128, 129, 302, 303, 308, 310, 312
See application file for complete search history.

(56) References Cited

U.S. PATENT DOCUMENTS

| | | | | |
|---|---|---|---|---|
| 2,912,586 | A | 11/1959 | Gundlach | |
| 3,781,105 | A | 12/1973 | Meagher | |
| 4,851,960 | A | 7/1989 | Nakamura et al. | |
| 5,164,779 | A | 11/1992 | Araya et al. | |
| 5,321,476 | A | 6/1994 | Gross | |
| 5,420,677 | A | 5/1995 | Gross et al. | |
| 5,613,173 | A | 3/1997 | Kunzmann et al. | |
| 5,849,399 | A | 12/1998 | Law et al. | |
| 6,600,895 | B2 | 7/2003 | Fletcher et al. | |
| 6,606,477 | B2 | 8/2003 | Thompson et al. | |
| 6,611,665 | B2 * | 8/2003 | DiRubio et al. | 399/9 |
| 7,072,599 | B2 * | 7/2006 | DiRubio et al. | 399/66 |
| 7,177,572 | B2 | 2/2007 | DiRubio et al. | |
| 7,512,367 | B2 | 3/2009 | Parks | |
| 2003/0133729 | A1 | 7/2003 | Thompson et al. | |
| 2009/0297235 | A1 * | 12/2009 | Nishimura | 399/329 |
| 2009/0304408 | A1 | 12/2009 | DiRubio et al. | |

* cited by examiner

*Primary Examiner* — Walter L Lindsay, Jr.
*Assistant Examiner* — Frederick Wenderoth
(74) *Attorney, Agent, or Firm* — Fay Sharpe LLP

(57) ABSTRACT

Disclosed are methods and apparatus for marking an image on a media substrate using an intermediate transfer printing arrangement. Specifically disclosed is an image transfer nip arrangement associated with a secondary transfer of an image which utilizes a constant current source to generate an electric field across the nip and transfer toner from an intermediate transfer surface to a media substrate.

38 Claims, 9 Drawing Sheets

IMAGE TRANSFER NIP METHOD AND APPARATUS USING CONSTANT CURRENT CONTROLS

BACKGROUND

The present exemplary embodiment relates to document processing systems such as printer, copier, multifunction devices, etc., and operating methods to transfer an image from an intermediate surface to a media substrate.

Traditional Intermediate Belt Transfer (IBT) systems using semiconductive back-up rolls (BUR) and biased image transfer rolls (ITRs) at a second transfer require constant BUR or ITR voltage control. The voltage is determined by a feed-forward control algorithm with a complex look-up table that depends on paper weight, paper size, temp, humidity, and simplex vs duplex in order to control the transfer field and maintain adequate transfer latitude. This system requires an enormous amount of sensitivity testing, algorithm development and confirmation testing. Experiments show that even mature, carefully constructed constant voltage control algorithms often set voltages far enough from the optimal voltage to significantly degrade image quality.

Disclosed is a transfer nip design that enables a simpler, more accurate/robust control algorithm. The second transfer nip is modified to enable a constant current control system similar to that employed at first transfer.

Incorporation by Reference

The following patents and patent application publications are totally incorporated herein by reference:

U.S. Pat. No. 7,512,367 to Parks, entitled "Ultrasonic Backer for Bias Transfer Systems," issued Mar. 31, 2009.

U.S. Pat. No. 7,177,572 to DiRubio et al., entitled "Biased Charge Roller with Embedded Electrodes with Post-Nip Breakdown to Enable Improved Charge Uniformity," issued Feb. 13, 2007.

U.S. Pat. No. 6,611,665 to DiRubio, entitled "Method and Apparatus Using a Biased Transfer Roll as a Dynamic Electrostatic Voltmeter for System Diagnostics and Closed Loop Process Controls," issued Aug. 26, 2003.

U.S. Pat. No. 6,606,477 to Thompson et al., entitled "Method to Control Pre- and Post-Nip Fields for Transfer," issued Aug. 12, 2003

U.S. Pat. No. 6,600,895 to Fletcher et al., entitled "Printing Machine and Method Using a Bias Transfer Roller Including at Least One Temperature-Maintaining Device," issued Jul. 29, 2003.

U.S. Pat. No. 5,849,399 to Law et al., entitled "Bias Transfer Members with Fluorinated Carbon Filled Fluoroelastomer Outer Layer," issued Dec. 15, 1998.

U.S. Pat. No. 5,613,173 to Kunzmann et al., entitled "Biased Roll Charging Apparatus Having Clipped AC Input Voltage," issued Mar. 18, 1997.

U.S. Pat. No. 5,420,677 to Gross et al., entitled "Method and Apparatus for Extending Material Life in a Bias Transfer Roll," issued May 30, 1995.

U.S. Pat. No. 5,321,476 to Gross, entitled "Heated Bias Transfer Roll," issued Jun. 14, 1994.

U.S. Pat. No. 5,164,779 to Araya et al., entitled "Image Forming Apparatus with Dual Voltage Supplies for Selectively Charging and Discharging an Image Bearing Member," issued Nov. 17, 1992.

U.S. Pat. No. 4,851,960 to Nakamura et al., entitled "Charging Device," issued Jul. 25, 1989.

U.S. Pat. No. 3,781,105 to Meagher, entitled "Constant Current Biasing Transfer System," issued Dec. 25, 1973.

U.S. Pat. No. 2,912,586 to Gundlach, entitled "Xerographic Charging," issued Nov. 10, 1959.

U.S. Patent Application Publication No. 2009/0304408, to DiRubio et al., entitled "Multi-Color Printing System and Method for High Toner Pile Height Printing," published Dec. 10, 2009.

U.S. Patent Application Publication No. 2003/0133729 to Thompson et al., entitled "Method to Control Pre- and Post-Nip Fields for Transfer," published Jul. 17, 2003.

Brief Description

In one embodiment of this disclosure, described is a method of marking an image on a media substrate using an intermediate image transfer printing apparatus, the intermediate image transfer printing apparatus including a photoreceptor surface; an exposure station operatively associated with the photoreceptor surface; a developer system operatively associated with the photoreceptor surface; an intermediate image transfer surface operatively associated with the photoreceptor surface; and an image transfer nip operatively associated with the intermediate image transfer surface, the image transfer nip including a Backup Roll and a Paper Escort Apparatus to engage a media sheet, and one or more of the Backup Roll, Paper Escort Apparatus and the image transfer surface including a dielectric material, the method comprising a) forming an electrostatic image on the photoreceptor surface representative of an image to be marked on a media substrate using the exposure system; b) developing the electrostatic image on the photoreceptor surface with toner material using the developer system to generate a developed image; c) transferring the developed image from the photoreceptor surface to the intermediate image transfer surface; d) advancing the developed image on the intermediate image transfer surface to the image transfer nip; and e) generating an electric field across the image transfer nip utilizing a constant current source operatively connected to the Backup Roll and the Paper Escort Apparatus, whereby, the generated electric field transfers the developed image from the intermediate image transfer surface to a media sheet.

In another embodiment of this disclosure, described is an intermediate image transfer marking apparatus comprising a photoreceptor surface; an exposure station operatively associated with the photoreceptor surface; a developer system operatively associated with the photoreceptor surface; an intermediate image transfer surface operatively associated with the photoreceptor surface; an image transfer nip operatively associated with the intermediate image transfer surface, the image transfer nip including a Backup Roll and a Paper Escort Apparatus configured to engage a media sheet, and one or more of the Backup Roll, Paper Escort Apparatus and intermediate image transfer surface including a dielectric material; and a controller operatively associated with the photoreceptor surface, the exposure station, the developer system, the intermediate image transfer surface and the image transfer nip, the controller configured to execute a process of marking an image on a media substrate using the intermediate image transfer marking apparatus, the process comprising a) forming an electrostatic image on the photoreceptor surface representative of an image to be marked on a media substrate using the exposure system; b) developing the electrostatic image on the photoreceptor surface with toner material using the developer system to generate a developed image; c) transferring the developed image from the photoreceptor surface to the intermediate image transfer surface; d) advancing the developed image on the intermediate image transfer surface to the image transfer nip; and e) generating an electric field across the image transfer nip utilizing a constant current source operatively connected to the Backup Roll and the Paper Escort Apparatus.

In still another embodiment of this disclosure, described is an intermediate image transfer marking apparatus comprising a photoreceptor drum; an exposure station operatively associated with the photoreceptor drum; a developer system operatively associated with the photoreceptor drum; an intermediate image transfer surface operatively associated with the photoreceptor drum; an image transfer nip operatively associated with the intermediate image transfer surface, the image transfer nip including a Backup Roll and a Paper Escort Apparatus configured to engage a media sheet, and one or more of the Backup Roll, Paper Escort Apparatus and intermediate image transfer surface including a dielectric material; a fuser; and a controller operatively associated with the photoreceptor drum, the developer system, the intermediate image transfer surface and the image transfer nip, the controller configured to execute a process of marking an image on a media substrate using the intermediate image transfer image marking apparatus, the process comprising a) forming an electrostatic image on the photoreceptor drum representative of an image to be marked on a media substrate using the exposure system; b) developing the electrostatic image on the photoreceptor drum to generate a developed image using the developer system; c) transferring the developed image from the photoreceptor drum to the intermediate image transfer surface; d) advancing the developed image on the intermediate image transfer surface to the image transfer nip; e) generating an electric field across the image transfer nip utilizing a constant current source operatively connected to the Backup Roll, the Paper Escort Apparatus and the dielectric material, whereby the generated electric field transfers the developed image from the intermediate image transfer surface to a media sheet; and f) fusing the image transferred to the media sheet using the fuser.

DETAILED DESCRIPTION

Figure 1:
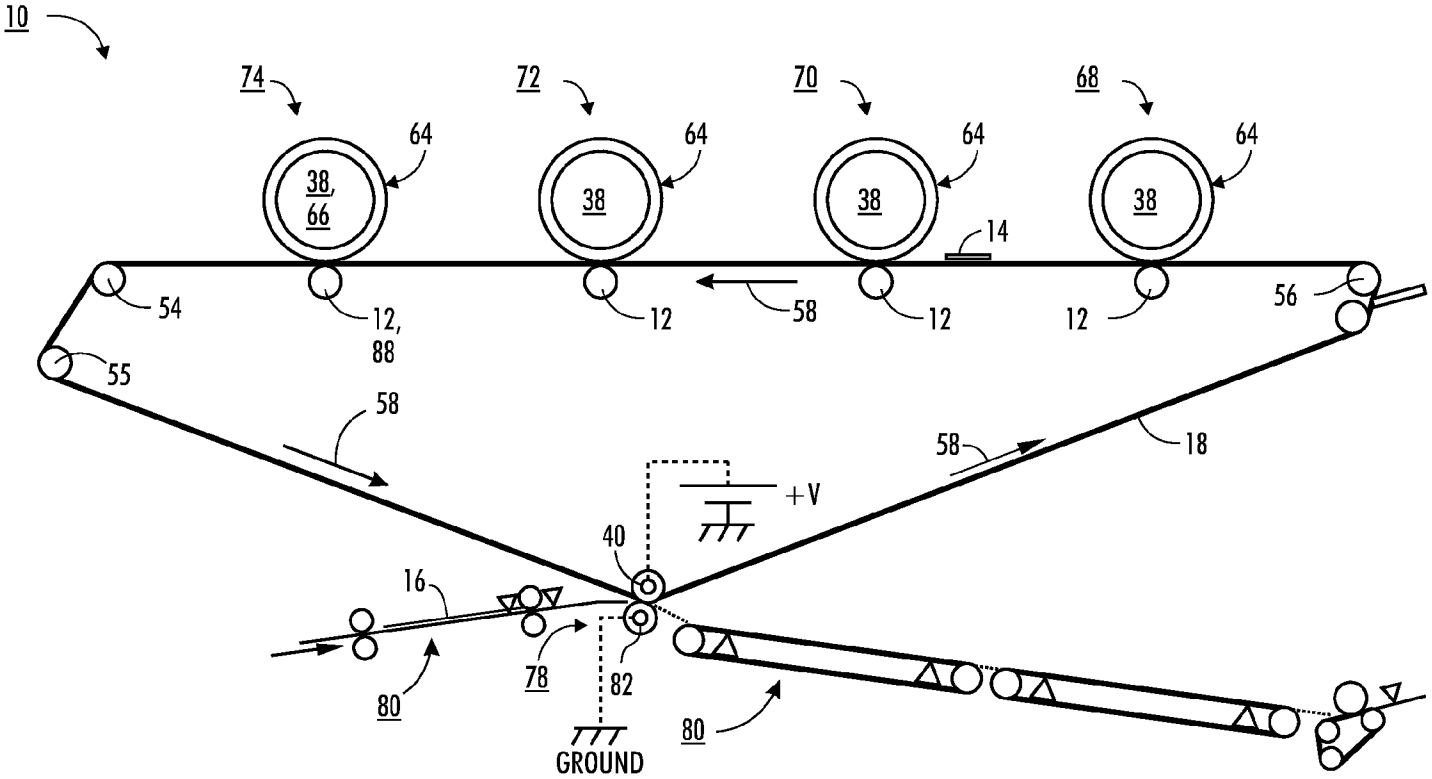
FIG. 1 is a schematic of a xerographic printer implementing one exemplary embodiment of a biased image transfer roll according to this disclosure.
Figure 9:
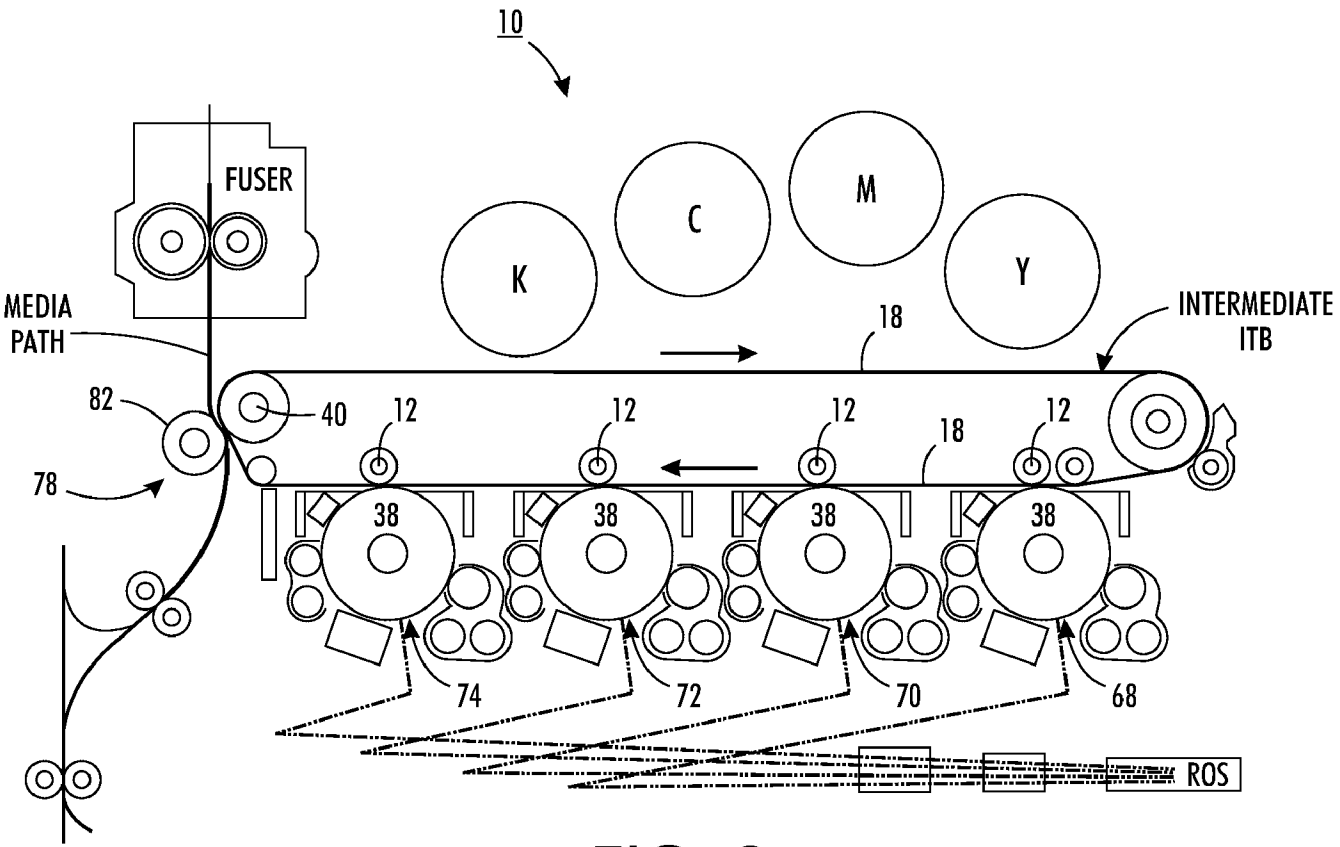
FIG. 9 is a schematic of a xerographic printer implementing a constant current secondary image transfer system according to an exemplary embodiment of this disclosure.

Referring to FIG. 1 and FIG. 9, there is shown a schematic view of a xerographic printer 10, such as a copier or laser printer, incorporating features of the present disclosure. Although the present disclosure will be described with reference to the embodiment shown in the drawings, it should be understood that the present disclosure can be embodied in many alternate forms of embodiments. In addition, any suitable size, shape or type of elements or materials could be used.

With reference to FIG. 1 and FIG. 9, illustrated is a xerographic printer 10 which includes at least one biased first image transfer roll 12 for transferring toner from the surface 64 of a photoconductive drum to an intermediate transfer surface 18. Many xerographic printers 10 also use at least one biased second image transfer roll 82 for transferring developed toner 14 from an intermediate transfer surface 18 to a sheet-type substrate 16. While transferring imaged toner 14 to a an intermediate transfer surface and subsequently to a sheet type substrate 16 is shown and described, the present disclosure is not so limited, as biased image transfer rolls can also be used to transfer to continuous rolls of paper, without departing from the broader aspects of the present disclosure. Some high volume xerographic printers 10 may have five or more biased first image transfer rolls 12, while many low volume xerographic printers 10 have at least one biased first image transfer roll 12.

U.S. Pat. No. 3,781,105 discloses some examples of a biased image transfer roll used in a xerographic printer. Notably, image transfer rolls can also be referred to as a bias transfer roll (BTR). Some of the details disclosed therein may be of interest as to teachings of alternatives to details of the embodiment herein.

Figure 2:
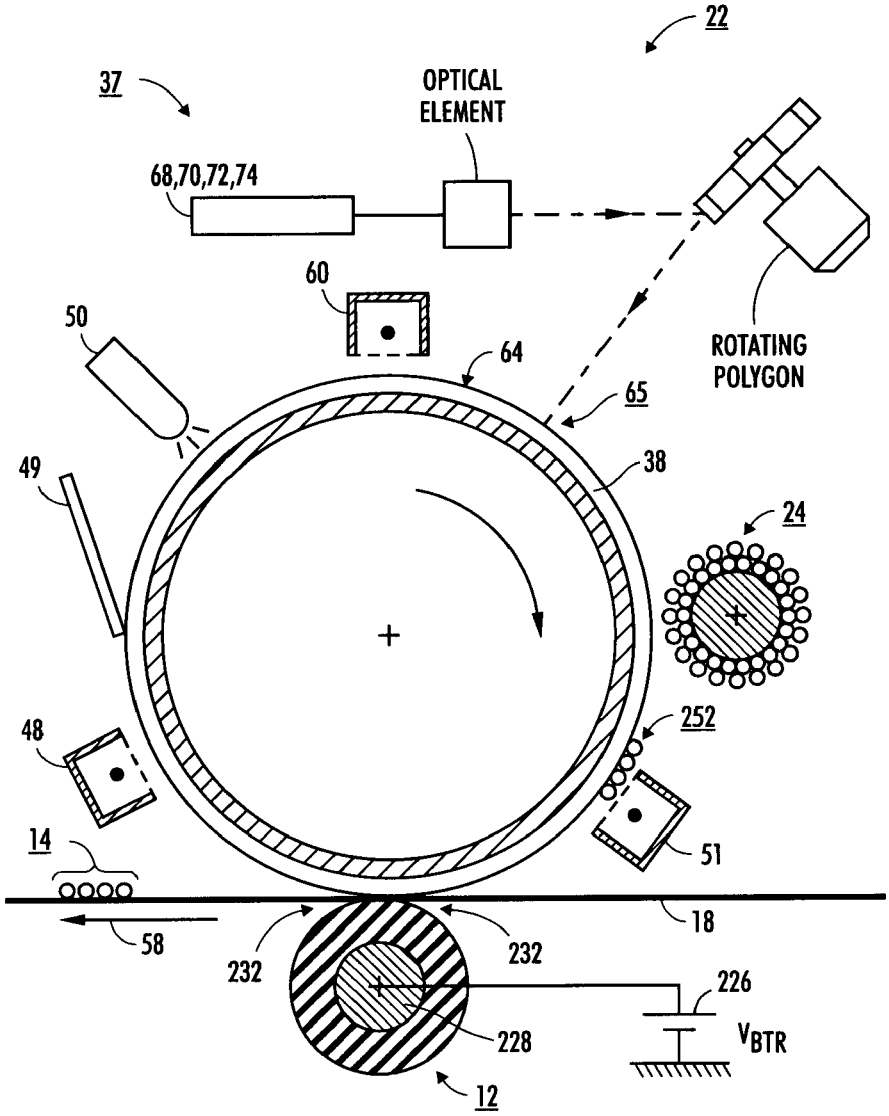
FIG. 2 is a schematic of one exemplary embodiment of a xerographic station incorporating a biased image transfer roll according to this disclosure.

Referring now to FIG. 2, the biased first image transfer roll 12 is generally operated in a constant current mode, in which a high voltage power supply 226 varies a voltage ($V_{BTR}$) applied to a steel shaft 228 of the biased image transfer roll 12 to maintain a constant current. In one embodiment, changes in the level of voltage of the biased image transfer roll 12 can be used to indicate a change in the electric field in air gaps leading to and from each nip, which is the contact or almost contact area having small or zero air gaps between the biased image transfer roll 12 and, for example, a photoconductor drum 38. A nip region 232 generally includes the air gaps upstream of the nip (pre-nip region), and the air gaps downstream of the nip (post-nip region). The first biased image transfer roll 12 can function in a dynamic mode where the components, such as photoreceptor, belts and toner, are moving through the nip region 232.

Notably, the electric field of the first biased image transfer roll 12 in the nip region 232 can be affected by an electrical field generated by components of the xerographic printer 10 passing through the nip region 232. The voltage ($V_{BTR}$) applied to the shaft 228 of the first biased image transfer roll 12 shifts in response to changes in the operating properties of subsystems 22, and the electrical field of the various components of the subsystem 22.

Before describing the particular features of the present disclosure in detail, an exemplary xerographic printer 10 will be further described, which can be a black and white or multicolor copier or laser printer. To initiate a copying process, a multicolor original document is positioned on a raster input scanner (RIS) which captures the entire image from original document which is then transmitted to a raster output scanner (ROS) 37. Alternatively, as in the case of a printer, RIS type data is communicated to a printer for rendering. The raster output scanner 37 illuminates a charged portion of a photoconductor 64 of a photoconductor drum (OPC) 38, or photoconductor drums 38, of a xerographic printer 10. Notably, a charging station 60 including a corona generating device or other charging device generates a charge voltage to charge the photoconductive surface 64 prior to the raster output scanner 37 illuminating the photoconductor 64. While a photoconductor drum 38 has been shown and described, the present disclosure is not so limited, as the photoconductor surface 64 may be a type of belt or other structure, without departing from the broader aspects of the present disclosure. The raster output scanner 37 exposes each photoconductor drum 38 to record one of the four subtractive primary latent images.

Continuing with FIG. 2, one latent image is to be developed 24 with a cyan developer material, which is a type of toner. Another latent image is to be developed 24 with magenta developer material, a third latent image is to be developed 24 with yellow developer material, and a fourth latent image is to be developed 24 with black developer material, each on their respective photoconductor drums 38. These developed images 252 are charged with an optional pre-transfer subsystem 51 and sequentially transferred to an intermediate surface 18, and subsequently transferred to a copy sheet in superimposed registration with one another to form a multicolored image on the copy sheet which is then fused thereto to form a color copy. The photoconductor drum 38 is cleaned after the transfer with the use of an optional pre-clean subsystem 48, a clean subsystem 49 and an erase lamp 50.

Referring again to FIG. 1 and FIG. 9, the xerographic printer 10 can include an intermediate image transfer surface 18 which is entrained about first biased image transfer rolls 12, second image transfer roll 82, backup roll 40, tensioning rollers 54, steering roller 55, and drive roller 56. As drive roller 56 rotates, it advances the intermediate image transfer surface 18 in the direction of arrow 58 to sequentially advance successive portions of the intermediate image transfer surface 18 through the various processing stations disposed about the path of movement thereof. The intermediate image transfer surface 18 usually advances continuously as the xerographic printer operates.

Referring again to FIG. 2, initially, a portion of each of the photoconductor drums 38 passes through a charging station 60. At the charging station 60, a corona generating device or other charging device generates a charge voltage to charge the photoconductive surface 64 of each photoconductor drum 38 to a relatively high, substantially uniform voltage potential ($V_{opc}$).

As shown in FIG. 2, each charged photoconductor drum 38 is rotated to an exposure station 65. Each exposure station 65 receives a modulated light beam corresponding to information derived by raster input scanner having a multicolored original document positioned thereat. Alternatively, in a laser printing application the exposure may be determined by the content of a digital document. The modulated light beam impinges on the surface 64 of each photoconductor drum 38, selectively illuminating the charged surface 64 to form an electrostatic latent image thereon. The photoconductive surface 64 of each photoconductor drum 38 records one of three latent images representing each color. The fourth photoconductive drum 66 may include black toner and can be used to print black and white documents. Also, one or more other stations may be added, for example, a fifth and sixth station including other toner colors to enhance the color gamut of the printer, improve image gloss, etc.

With reference to FIG. 1 and FIG. 9, after the electrostatic latent images have been recorded on each photoconductor drum 38, the intermediate image transfer surface 18 is advanced toward each of four xerographic stations indicated by reference numerals 68, 70, 72 and 74. The full color image is assembled on the intermediate image transfer surface 18 in four first image transfer steps, one for each of the primary toner colors. Xerographic stations 68,70,72,74 respectively, apply toner particles of a specific color on the photoconductive surface 64 of each photoconductor drum 38.

Referring again to FIG. 2, as the intermediate image transfer surface passes by each xerographic station 68,70,72,74, the respective photoconductor drum 38 rotates with the movement of the intermediate image transfer surface 18 to synchronize the movement of the toner image 14 laid down on the intermediate image transfer surface 18 by the previous xerographic station(s) 68, 70, 72, with the rotation of the toner 252 on each photoconductor drum 38. Each developed image 252 recorded on each of the photoconductive surfaces 64 of each photoconductor drum 38 is transferred, in superimposed registration with one another, to the intermediate image transfer surface 18 for forming the multi-color copy of the colored original document.

Continuing with reference to FIG. 2, the convergence of the biased first image transfer roll 12 and each photoconductor drum 38 form a nip 232 in which the toner particles 252 from the photoconductor surface 64 and the intermediate image transfer surface 18 enter synchronously. The biased first image transfer roll 12 causes the toner image 252 on the photoconductor drum 38 to transfer to the intermediate image transfer surface 18, and merge with any toner particles 14 previously transferred to the intermediate image transfer surface 18. As the transfer begins, the surface 64 of the photoconductor drum 38, the intermediate image transfer surface 18, and any toner 14, 252 present on either, enter the air gaps associated with nip region 232.

Referring again to FIG. 1 and FIG. 9, after development, the toner image 14 is moved to an image transfer station 78 which defines the position at which the toner image 14 is transferred to a sheet of support material 16, which may be a sheet of plain paper or any other suitable support substrate. A sheet transport apparatus 80 moves the sheet 16 into contact with intermediate image transfer surface 18. During sheet transport, the sheet 16 is moved into contact with the intermediate image transfer surface 18, in synchronism with the toner image 14 developed thereon.

As shown in FIG. 1 and FIG. 9, the toner image 14 on the intermediate image transfer surface 18 is transferred, in superimposed registration with one another, to the sheet 16 for forming a multi-color copy of the colored original document. A backup roll 40 together with a biased second image transfer roll 82 transfer the toner image 14 to the sheet-type substrate 16. Alternatively (as in FIG. 4), a bias image transfer belt associated with a paper escort apparatus may be used to transfer the toner image 14 to the sheet-type substrate 16. Conventionally, a high voltage is applied to a steel roller associated with the backup roller 40 which produces a high voltage at the surface of the backup roller 40, while the biased image transfer roll 82 shaft is grounded. This creates an electric field that pulls the toner 14 from the intermediate image transfer surface 18 to the substrate 16.

The sheet transport system 80 directs the sheet for transport to a fusing station and removal to a catch tray. Each photoconductor drum 38 also includes a cleaning station including an optional pre-clean subsystem 48, and a cleaner subsystem 49 for removing residual toner. An erase lamp subsystem 50 removes residual charge.

The foregoing description should be sufficient for purposes of the present disclosure to illustrate the general operation of a xerographic printer 10 or copier incorporating the features of the present disclosure. As described, a xerographic printer 10 may take the form of any of several well-known devices or systems. Variations of specific xerographic processing subsystems or processes may be expected without affecting the operation of the present disclosure.

As discussed in the Background section, traditional Intermediate Belt Transfer (IBT) systems using semiconductive back-up rolls (BUR) 40, intermediate transfer surfaces such as belts 18, and biased image transfer rolls (ITRs) 82 at a second image transfer, require constant BUR or ITR voltage control. Conventionally, the voltage is determined by a feed-forward control algorithm with a complex look-up table that depends on paper weight, paper size, temp, humidity, and simplex vs duplex in order to control the transfer field and maintain adequate transfer latitude. This system requires an enormous amount of sensitivity testing, algorithm development and confirmation testing. Experiments show that even mature, carefully constructed constant voltage control algorithms often set voltages far enough from the optimal voltage to significantly degrade image quality.

Disclosed is a second transfer nip design that enables a simpler, more accurate/robust control algorithm. The conventional second transfer nip is modified to enable a constant current control system similar to that employed at the first image transfer. Four examples are provided. These examples describe specific simple electrical biasing schemes, but other electrical biasing schemes are possible.

EXAMPLE 1

FIG. 7

Replace the conventional grounded biased second image transfer roll 82 associated with a paper escort apparatus with one of the following:

a) a small diameter negative charging photoreceptor coupled with an appropriate erase lamp, AC corona device (corotron, dicorotron or scorotron) or AC BCR (Biased Charging Roll) to neutralize the drum after transfer. For examples of BCRs, see U.S. Pat. Nos. 4,851,960; 5,164,779; 5,613,173; and 2,912,586. (Notably, utilizing an AC discharge device instead of a photodischarge erase lamp, the drum is only required to have a dielectric coating, not a photosensitive coating. In addition, a dielectric overcoat of a conformable conductive foam provides additional opportunities for transfer nip optimization.)

b) a dielectric coated metal drum; and c) a dielectric coated conformable conductive foam.

In each arrangement, a), b) and c), a constant negative DC current is applied to bias a BUR 40, and the a) photoreceptor, b) metal drum or c) conductive foam is grounded, thereby providing a transfer of toner from the intermediate ITB to the paper.

EXAMPLE 2

FIG. 8

Replace the conventional conductive back-up roll (BUR) 40 with one of the following:

a) a small diameter positive charging photoreceptor coupled with an appropriate erase lamp, AC corona device (corotron, dicorotron or scorotron) or AC BCR to neutralize the drum after transfer. (As in Example 1, a photosensitive drum is not required with an AC discharge device and a dielectric overcoat of conductive foam provides additional opportunities for transfer nip optimization.)

b) a dielectric coated metal drum; and c) a dielectric coated conformable conductive foam.

In each arrangement, a), b) and c), a constant positive DC current is applied to bias the ITR 82 and the a) photoreceptor BUR, b) dielectric coated metal drum BUR or c) dielectric coated BUR 40 with conformable conductive foam is grounded, thereby providing a transfer of toner from the intermediate ITB to the paper.

EXAMPLE 3

FIG. 10

Replace semiconductive Paper Escort ITB associated with a Paper Escort Apparatus with one of the following:

a) a grounded negative charging photoreceptor belt coupled with an appropriate erase lamp, AC corona device (corotron, dicorotron or scorotron) or AC BCR (biased charging roll) to neutralize the belt after transfer. (As in Example 1, utilizing an AC discharge device instead of a photodischarge erase lamp, the belt is only required to have a dielectric coating, not a photosensitive coating.); and b) a dielectric coated ITB 18.

In each arrangement, a) and b), a constant negative DC current is applied to bias the BUR 40, and the a) photoreceptor belt or b) ITR 82 inside the paper escort apparatus is grounded, thereby providing a transfer of toner from the intermediate ITB to the paper.

EXAMPLE 4

Not Shown

Replace the conventional semiconductive intermediate ITB with a semiconductive ITB including a dielectric layer. In this arrangement, the detailed electrical biasing scheme will be dependent on other design details. In one embodiment a constant positive DC current is applied to bias the Paper Escort ITR and the BUR is grounded, thereby providing a transfer of toner from the intermediate ITB to the paper. In another embodiment a constant negative DC current may be applied to bias the BUR and the ITR is grounded, thereby providing a transfer of toner from the ITB to the paper.

Notably, other variations of this example are described below.

As previously stated, Intermediate Belt Transfer (IBT) systems employ multiple constant current biased ITRs (Image Intermediate Transfer Rolls) behind the belt for $1^{st}$ transfer from the photoreceptor drums to the ITB. They also employ constant voltage applied to the Backup Roll (BUR) or Image Transfer Roll (ITR) for a second image transfer from the ITB to paper utilizing a paper escort apparatus including a biased ITR located behind the paper escort image transfer belt. The electrical and power supply control design is set up to try and control the electric field in the transfer nips which provides the force required to transfer toner.

In the $1^{st}$ transfer the photoreceptor drum acts as an insulator in the dark. Therefore essentially all of the current flow is due to the movement of surfaces carrying charge that has been deposited during air breakdown. In this case, constant current mode is constant charge deposition mode, which means it's a close approximation to constant field mode. To make constant current mode robust (i.e. closer to constant field mode), transfer current may be varied modestly as a function of the image transfer roll (ITR) and intermediate image transfer belt (ITB) electrical properties as they vary due to manufacturing variation, temperature, humidity and aging. Typically, however, it is not necessary to vary the current to insure sufficiently constant field.

In conventional biased ITR and biased paper escort ITB second transfers from an intermediate image transfer belt (ITB) to paper systems, the component electrical properties are all resistive. The resistivity of each layer of the ITR, biased ITB, ITB, and BUR components (see FIGS. 3 and 4) are all carefully chosen to optimize performance. Typically none of the layers are insulating at the high fields employed during printing. In second image transfer, constant current does not insure constant field because there is a large, variable static (ohmic) current flow from the biased element to ground through these components. Conventional practice instead is to control the back-up roll (BUR) or biased image transfer roll (ITR) voltage. (See FIGS. 3 and 4.) This must be varied by well over a factor of 5 (less than 500V to over 2500V) in order to come close to achieving constant electric field for all substrates, all zones, and all component variation. Implementation of BUR/ITR voltage control requires special diagnostic modes to measure $2^{nd}$ image transfer system resistance. This is then fed into lookup tables which calculate the required applied voltage as a function of temperature, humidity, substrate weight and $1^{st}$ vs $2^{nd}$ side transfer. This requires the overhead of a very large amount of machine Non-Volatile Memory as well a large amount of testing to define the algorithms. Experiments show that even mature, carefully constructed constant voltage control algorithms often set voltages far enough from the optimal voltage to significantly degrade image quality. In other words the control algorithm can do a poor job of selecting a voltage that insures that the peak transfer field—which generates the force required to transfer the toner—is optimal.

Figure 4:
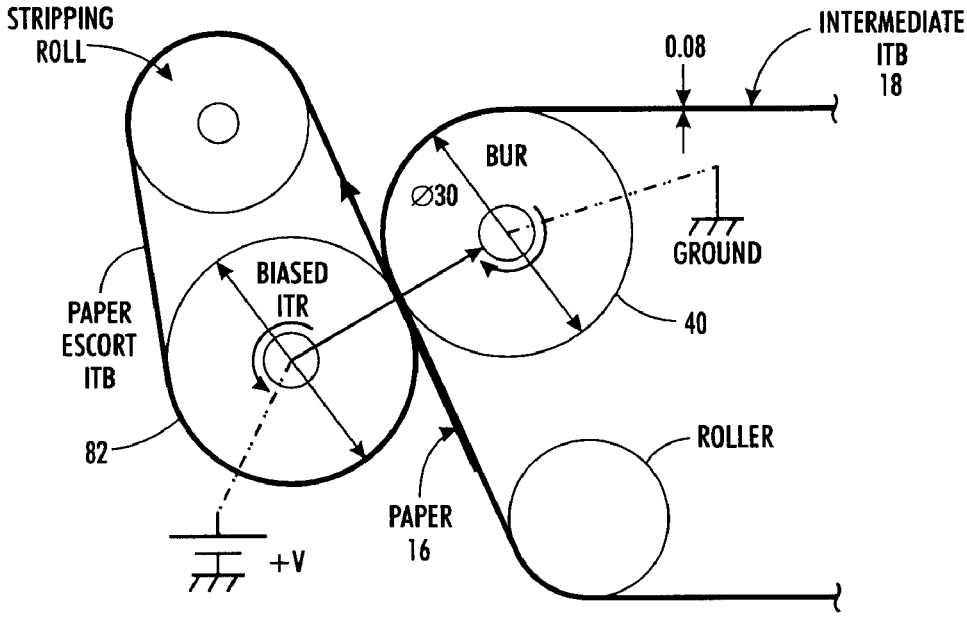
FIG. 4 is a schematic of another secondary image transfer nip associated with an image marking apparatus, the secondary image transfer nip including a stripping roll and a biased image transfer belt (referred to as Paper Escort ITB).
Figure 5:
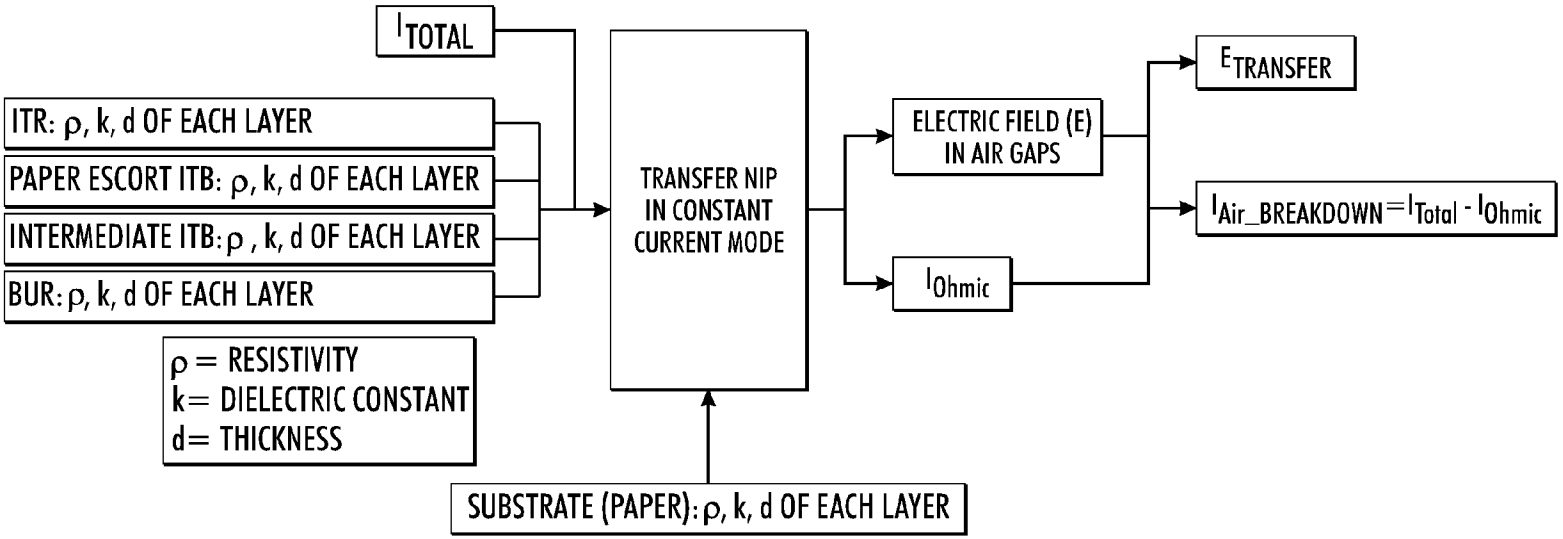
FIG. 5 is a block diagram of a constant current associated with a secondary image transfer nip control system according to an exemplary embodiment of this disclosure.

FIG. 5 illustrates a block representation of a transfer nip in constant current ($I_{TOTAL}$) mode to further explain a transfer nip in constant current mode. The total current $I_{Total}=I_{Ohmic}+I_{Air_Breakdown}$ is the total current delivered by the power supply. It has two components $I_{Ohmic}$ and $I_{Air_Breakdown}$. $I_{Ohmic}$ is the ohmic (or static) current due to conventional ohmic current flow through all of the layers of the nip. For example in FIGS. 3 and 4, $I_{Ohmic}$ primarily consists of current that flows from the biased ITR shaft to the grounded BUR shaft. This current flows whether or not the components are in motion, hence we sometimes refer to it as "static" current flow as opposed to "dynamic" current flow (belts and rollers in motion). In transfer from an intermediate image transfer surface/member (belt or drum) to a substrate, none of the layers of the components (ITR, Paper Escort ITB, BUR, intermediate ITB) is an insulator, so $I_{Ohmic}$ is non-zero and is typically on the same order as $I_{Air_Breakdown}$, the current due to charge deposition on the moving surfaces caused by air breakdown. $I_{Air_Breakdown}$ is sometimes referred to as the "dynamic" current flow, because it requires motion of the components. The air breakdown is caused by the very large electric fields in the air gaps in the pre-nip and post-nip regions. The charge deposited on the moving surfaces (Intermediate ITB, Paper Escort ITB, BUR, ITR, paper) is conveyed out of the nip in a current $I_{Air_Breakdown}$.

If one or more layers of any of the components is an insulator, then $I_{Ohmic}=0$ and $I_{Total}=I_{Air_Breakdown}$. In this case $I_{Total}$ is solely a function of the electric fields in the air gaps, and constant $I_{Total}$ control insures that the air gap fields (E) are constant. Most importantly it insures that $E_{Transfer}$—the field in the air gap between the ITB and the substrate—is constant. A constant $E_{Transfer}$ insures consistently high transfer efficiency of the toner and robust (reproducible) transfer performance even as substrate, ITR, Paper Escort ITB, BUR, Intermediate ITB, and substrate properties vary significantly over time, and from part-to-part due to variation in manufacturing.

As previously discussed, FIG. 4 illustrates one conventional transfer nip for transferring toner from an intermediate image transfer member to a final substrate using a paper escort apparatus including a Paper Escort ITB entrained on two rollers, i.e., an image transfer roll and a stripper roll. The ITR, Paper Escort ITB, Intermediate ITB, and BUR may each consist of one or more layers of controlled conductivity materials.

Figure 3:
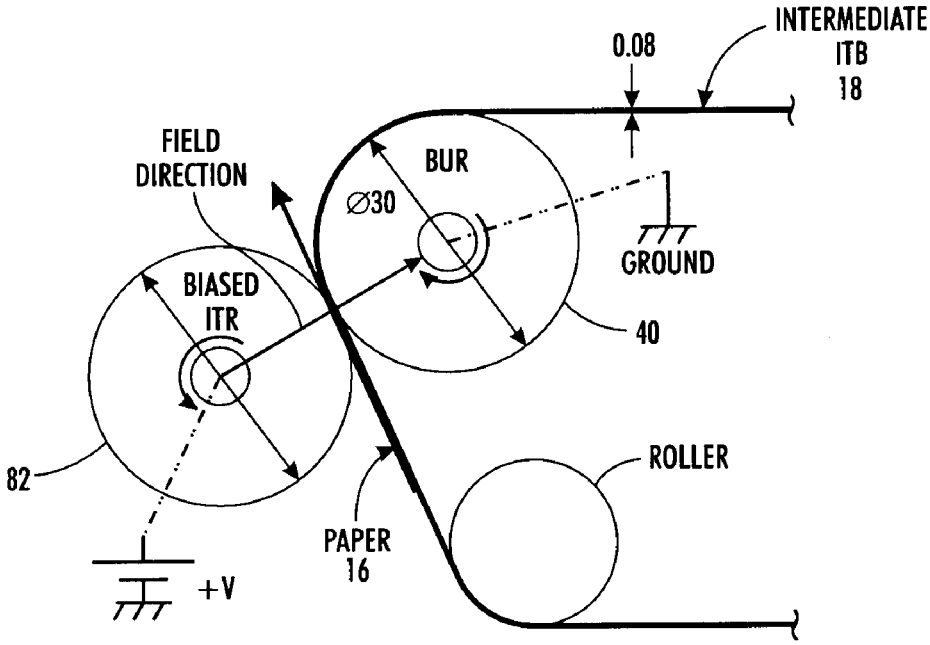
FIG. 3 is a schematic of a conventional secondary image transfer nip associated with an image marking apparatus.

To enable robust constant current control as disclosed herein, at least one layer of the ITR and/or Paper Escort ITB and/or BUR and/or Intermediate ITB must be sufficiently insulating to prevent static (ohmic) current flow between the high voltage power supply and ground. For example, but not limited to:

- The ITR, Paper Escort ITB, BUR, and Intermediate ITB may each contain one or more insulating layers (including the central shaft). Notably, a biased ITB is not required for the paper escort apparatus, as shown in FIG. 3.
- The insulating layer may be any layer of either the ITR, the Paper Escort ITB, BUR or the Intermediate ITB. Preferably the insulating layer is the outer layer of one of the Paper Escort ITB, ITR or BUR, but this is not a strict requirement. If the Paper Escort ITB (or Intermediate ITB) includes the insulating layer, then the discharge device is located on the Paper Escort ITB (or Intermediate ITB). Since both the inside and outside of the Paper Escort ITB (or Intermediate ITB) may become charged (depending on the design), neutralization devices may be included on both sides of the belt, preferably facing each other. There is a possibility that the Intermediate ITB may not need a neutralization device if it is sufficiently discharged due to air breakdown in the transfer nips.
- The Paper Escort ITB may be a photoreceptor belt with a conductive inner surface. For this case only one neutralization device is required, either an erase lamp on either side of the belt or an AC corona device on the outside of the belt.
- The insulating layer of the component (Paper Escort ITB, BUR, ITR, Intermediate ITB) should preferably have a dielectric thickness ($D_{INS}$) less than $D_{INS}<100$ microns to prevent the requirement for very high voltages to attain an adequate transfer field (roughly $E_{Transfer}>\sim 50$ Volts/micron). If $D_{INS}$ is the thickness of the insulating layer, and k is the dielectric constant, then the dielectric thickness is given by $D_{INS}=D_{INS}/k$. Therefore, if k=3 then $D_{INS}<300$ microns. In a typical implementation $D_{INS}$ may be significantly lower than 100 microns.
- The insulating layer should preferably have a resistivity that insures that the charge relaxation time is at least 10 times larger than the dwell time ($\tau_{RELAX}>10*t_{DWELL}$) in the nip. The dwell time for a thin section of substrate or ITB going through the nip is given by $t_{DWELL}=W_{NIP}/V_{PROCESS}$, where $W_{NIP}$ is the width of the nip (typically about 3 mm) and $V_{PROCESS}$ is the process speed (the surface speed of the substrate and ITB, on the order of 250 mm/s for 60 pages per minute). The relaxation time of the insulating layer is given by $\tau_{RELAX}=f(\rho_{INS}k\in_0)$, where k is the dielectric constant of the insulator, $\rho_{INS}$ is the resistivity of the insulator, $\in_0=8.85\times10^{-12}$ F/M is the permittivity of free space, and f is a constant that depends on the details of the design but may typically be in the range 1<f<10. Therefore $$\rho_{INS} > \frac{10W_{NIP}}{k\varepsilon_0 f V_{PROCESS}}$$

is preferable. In general it is preferable if the insulating layer has a very high resistivity.

Figure 6:
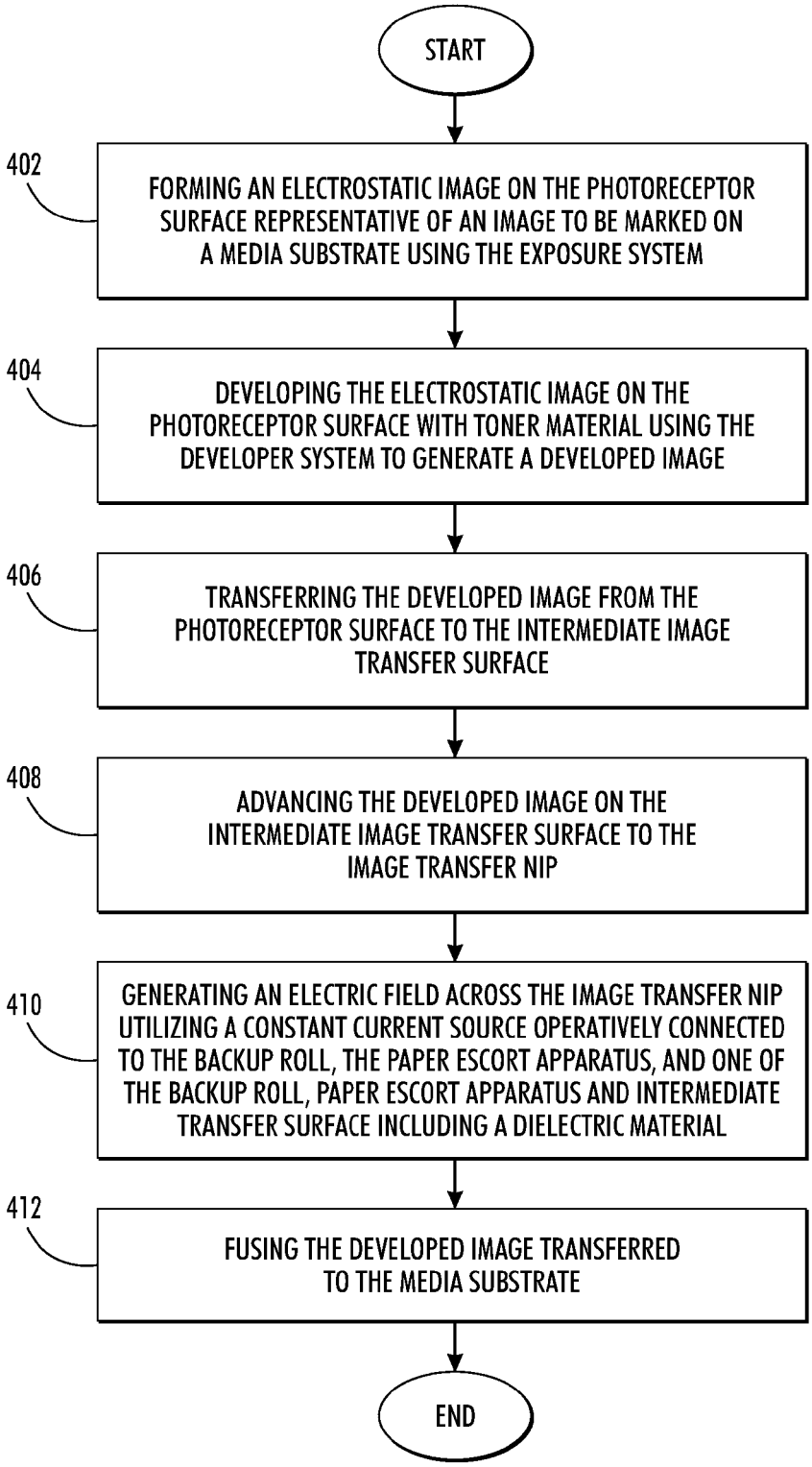
FIG. 6 is a flow chart of an exemplary method of marking an image using an intermediate transfer printing apparatus according to this disclosure.

With reference to FIG. 6, illustrated is a flow chart of an algorithm for marking an image on a media substrate using an intermediate image transfer printing apparatus according to an exemplary embodiment of this disclosure. The algorithm is executed by one or more controllers operatively connected to the intermediate image transfer printing apparatus. The intermediate image transfer printing apparatus including a photoreceptor surface; an exposure station operatively associated with the photoreceptor surface; a developer system operatively associated with the photoreceptor surface; an image transfer surface operatively associated with the photoreceptor surface; and an image transfer nip operatively associated with the image transfer surface, the image transfer nip including a Backup Roll and a Paper Escort apparatus to engage a media sheet, and one of the Backup Roll and Paper Escort apparatus and intermediate image transfer surface including a dielectric material, the method comprising a) forming an electrostatic image on the photoreceptor surface representative of an image to be marked on a media substrate using the exposure system 402; b) developing the electrostatic image on the photoreceptor surface with toner material using the developer system to generate a developed image 404; c) transferring the developed image from the photoreceptor surface to the image transfer surface 406; d) advancing the developed image on the image transfer surface to the image transfer nip 408; e) generating an electric field across the image transfer nip utilizing a constant current source operatively connected to the Backup Roll or the Paper Escort Apparatus, and one of the Backup Roll, Paper Escort Apparatus and Intermediate Image Transfer Surface including the dielectric material 410, whereby, the generated electric field transfers the developed image from the image transfer surface to a media sheet; and f) fusing the developed image transferred to the media substrate 412.

As previously discussed, this disclosure, and the exemplary embodiments contained herein, changes the design of the second image transfer system by replacing one of the base elements (ITR, Paper Escort ITB, BUR, or Intermediate ITB) with a capacitive (i.e., insulating or dielectric) element to simulate the $1^{st}$ transfer electrical design allowing implementation of constant current $2^{nd}$ transfer bias control. Since the capacitive item will remain charged after the $2^{nd}$ transfer step, an additional electrical discharge step is required. If a photosensitive device (such as a photoreceptor OPC drum or photoreceptor belt) is used, this can be accomplished with a low cost erase lamp. If a non-photosensitive device is used then this would require an AC charging device such as an AC biased charge roll (BCR) or AC corotron, scorotron, dicorotron, etc. (An AC discharge device could also be used with a photoreceptor). (An insulative layer within the intermediate transfer surface may not require an additional discharge device if there is sufficient air breakdown in $1^{st}$ transfer to neutralize the belt)

Figure 7:
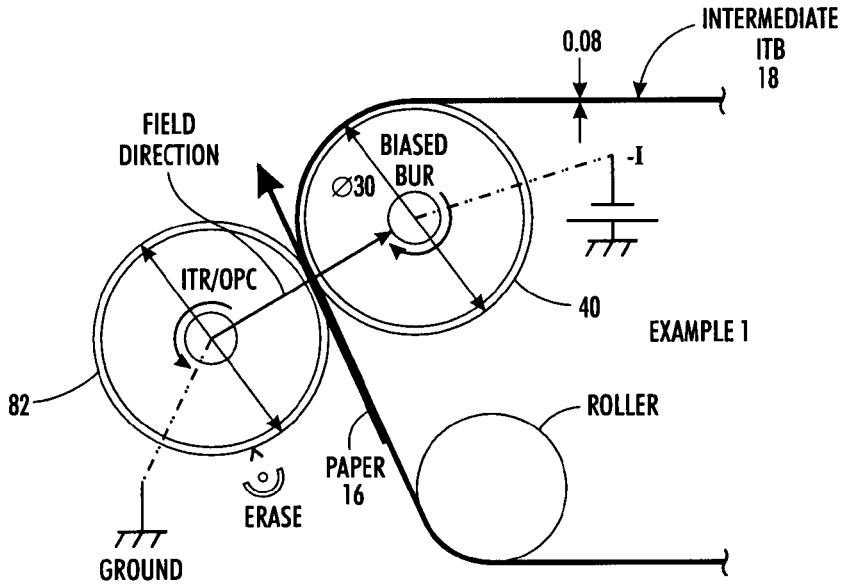
FIG. 7 is a schematic of an example 1 secondary image transfer nip arrangement according to an exemplary embodiment of this disclosure.
Figure 8:
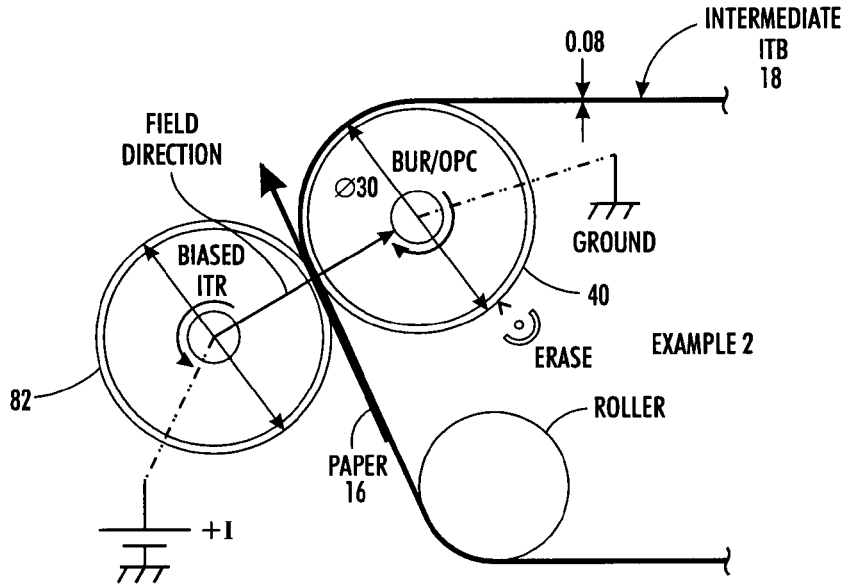
FIG. 8 is a schematic of an example 2 secondary image transfer nip arrangement according to an exemplary embodiment of this disclosure.
Figure 10:
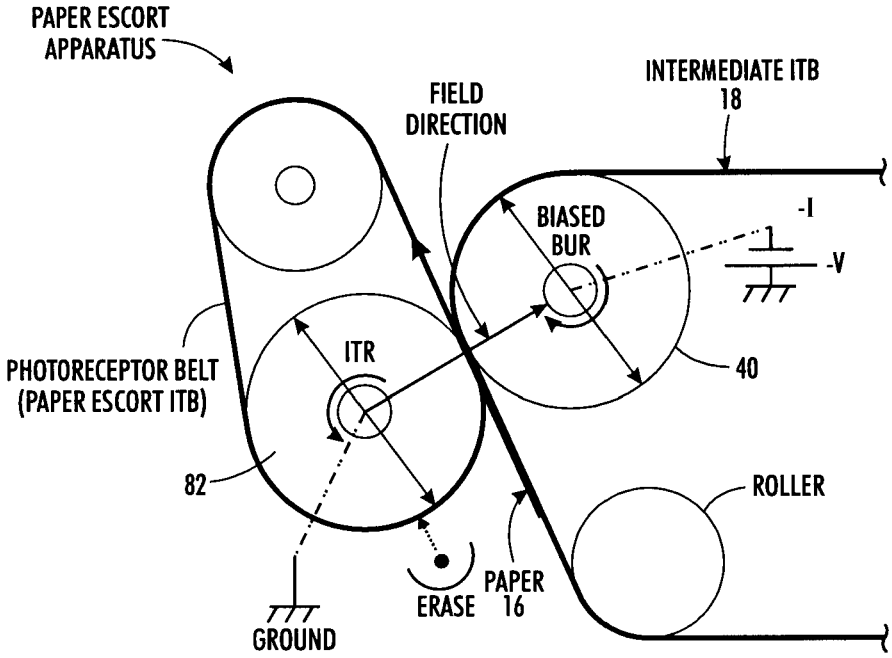
FIG. 10 is a schematic of an example 3 secondary image transfer nip arrangement according to an exemplary embodiment of this disclosure.

The capacitive element can be added to either the "top" or the "bottom" of the $2^{nd}$ transfer system. In the current $2^{nd}$ transfer system, negative voltage is applied behind the intermediate transfer belt (surface) (ITB) by the backup roll (BUR), or positive voltage is applied to the ITR. (See FIG. 3.) Example 1 (FIG. 7) is to replace the biased image transfer roll (ITR), which is located behind the paper (or behind a Biased Image Transfer belt located between the ITR and paper) with a small negatively charging OPC drum. The BUR within the intermediate ITB (image transfer belt), is biased negatively with respect to the "ground plane" on the inside of the OPC. The power supply is operated in constant current mode (FIG. 7). Example 2 is to replace the BUR inside the intermediate ITB with a small positively charging photoreceptor (FIG. 8). The ITR is biased positively relative to the OPC ground plane. Again, the power supply is operated in constant current mode. Example 3, (FIG. 10) which includes a Paper Escort ITB is to replace the ITB with a grounded photoreceptor belt. The BUR within the intermediate ITB, is biased negatively with respect to the "ground plane" on the inside of the OPC. The power supply is operated in constant current mode (FIG. 10). In all three examples an erase lamp can be added post transfer to discharge any residual charge from the surface of the drum or belt. Alternatively an AC charging system can be employed for discharge. This requires an AC high voltage source, but also enables utilizing a non-photosensitive roll or drum if that is desirable. Options for a non-photosensitive roll include an insulative sleeve overlayed onto a conductive foam roll. This provides the additional benefit of mechanical conformance adding another handle for transfer nip optimization. Other options include applying constant current to the OPC ground plane instead of the ITR. For the non-photoreceptor options, it is possible to apply constant current to the AC discharge system instead of to the ITR. A final example (Example 4) is to add the capacitive element to the intermediate image transfer belt. For this example, an additional discharge may not be required if there is sufficient air breakdown in the first transfer to neutralize the Intermediate Image Transfer Belt. (See Table 1 below for a summary of examples.)

TABLE 1

| Example | ITB Backup Roll | Paper Escort Roll | Paper Escort ITB | Intermediate ITB | Electric Field Source | Dielectric Charge Neutralization | Benefit |
|---|---|---|---|---|---|---|---|
| 1A | BUR | Negative OPC | None or Semi-Conductive | Semi-Conductive | BUR: Constant negative DC current. OPC grounded. | Erase Photo-discharge or AC corotron or AC BCR charge neutralization. | Conventional OPC and Erase |
| 1B | BUR | Dielectric Coating on Metal Drum | None or Semi-Conductive | Semi-Conductive | BUR: Constant negative DC current, | AC corotron or AC BCR charge | Low cost stable dielectric |

TABLE 1-continued

| Example | ITB Backup Roll | Paper Escort Roll | Paper Escort ITB | Intermediate ITB | Electric Field Source | Dielectric Charge Neutralization | Benefit |
|---|---|---|---|---|---|---|---|
| | | | | | Dielectric coated drum grounded. | neutralization | coated roll |
| 1C | BUR | Dielectric Coating on Conformable Conductive Foam | None or Semi-Conductive | Semi-Conductive | BUR: Constant negative DC current. Conductive foam grounded. | AC corotron or AC BCR charge neutralization | Conformable dielectric roll |
| 2A | Positive OPC | ITR | None or Semi-Conductive | Semi-Conductive | ITR: Constant positive DC current. OPC grounded. | Erase Photo-discharge or AC corotron or AC BCR charge neutralization | Architecture flexibility |
| 2B | Dielectric Coating on Metal Drum | ITR | None or Semi-Conductive | Semi-Conductive | ITR: Constant positive DC current. OPC grounded. | AC corotron or AC BCR charge neutralization | Low cost stable dielectric coated roll |
| 2C | Dielectric Coating on Conform-able Conduc-tive Foam | ITR | None or Semi-Conductive | Semi-Conductive | ITR: Constant positive DC current. OPC grounded. | AC corotron or AC BCR charge neutralization | Conformable dielectric roll |
| 3A | BUR | ITR | Negative Grounded Photo-receptor Belt | Semi-Conductive | BUR: Constant negative DC current. Photoreceptor grounded. | Erase Photo-discharge or AC corotron or AC BCR charge neutralization. | Conventional photo-receptor belt and Erase |
| 3B | BUR | ITR | BTB with Dielectric layer | Semi-Conductive | BUR: Constant negative DC current. Photoreceptor grounded. | AC corotron or AC BCR charge neutralization | Low cost stable dielectric coated belt |
| 4 | BUR | ITR | None or Semi-Conductive | Semi-Conductive with dielectric layer | BUR Constant negative DC current. or ITR: Constant positive DC current depending on design details. | AC corotron or AC BCR charge neutralization or possibly air breakdown in first transfer. | Architecture flexibility, Neutralization step not required |

This disclosure enables a simple, constant current control algorithm for the high voltage power supply that generates the transfer field. In the simplest implementation, the current required to insure a constant transfer field would be independent of the paper weight, temperature, RH, simplex/duplex, and paper coating. In practice, the current may not be a perfect surrogate for transfer field, in which case minor changes in the control current may be required for stress conditions. The current may also be varied to accommodate different paper widths. In short, this disclosure eliminates the need for highly complex LUTs (Look-Up Tables) required by the constant voltage system currently in use.

This disclosure provides a much more robust control algorithm and more stable/robust print quality: In a transfer nip containing a dielectric surface (like an OPC), the current is a direct measure of the transfer field. In order to maintain a constant current, the high voltage power supply automatically varies the applied voltage to insure a nearly constant transfer field independent of variation in temperature, RH, the substrate properties, ITR properties (resistivity, k=dielectric constant, etc.), Intermediate ITB properties (resistivity, k, etc.), and Paper Escort ITB properties (resistivity, k, etc.).

This disclosure enables rapid, straight forward, low cost re-optimization of the bias control algorithm if there are major design and/or system/platform changes. The target transfer current may need to be changed if there is a major redesign of key nip components or if the process speed is changed (platform variations). A relatively small effort would be required to find the new optimal current set point.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of marking an image on a media substrate using an intermediate image transfer printing apparatus, the intermediate image transfer printing apparatus including a photoreceptor surface; an exposure station operatively associated with the photoreceptor surface; a developer system operatively associated with the photoreceptor surface; an intermediate image transfer surface operatively associated with the photoreceptor surface; and an image transfer nip operatively associated with the intermediate image transfer surface, the image transfer nip including a backup roll and a paper escort apparatus to engage a media sheet, and one or more of the backup roll, paper escort apparatus and the intermediate image transfer surface including a dielectric material, the method comprising:

a) forming an electrostatic image on the photoreceptor surface representative of an image to be marked on a media substrate using the exposure system;

b) developing the electrostatic image on the photoreceptor surface with toner material using the developer system to generate a developed image;

c) transferring the developed image from the photoreceptor surface to the intermediate image transfer surface;

d) advancing the developed image on the intermediate image transfer surface to the image transfer nip; and e) generating an electric field across the image transfer nip utilizing a constant current source operatively connected to the backup roll and the paper escort apparatus, whereby, the generated electric field transfers the developed image from the intermediate image transfer surface to a media sheet, wherein the paper escort apparatus includes a conductive material operatively connected to a ground, the paper escort apparatus includes the dielectric material, and a charge neutralization system is operatively associated with the paper escort apparatus, step e) comprising:

e1) generating an electric field across the nip utilizing a constant current source operatively connected to the backup roll and the paper escort apparatus;

whereby the generated electric field transfers the developed image from the intermediate image transfer surface to a media sheet; and e2) neutralizing the dielectric material using the charge neutralization system.

2. The method of marking an image on a media substrate according to claim 1, wherein the photoreceptor surface is a photoreceptor drum and the intermediate image transfer surface is a belt.

3. The method of marking an image on a media substrate according to claim 2, wherein the belt includes the dielectric material.

4. The method of marking an image on a media substrate according to claim 1, further comprising:

f) fusing the developed image transferred to the media substrate.

5. The method of marking an image on a media substrate according to claim 1, wherein the paper escort apparatus is one or more of an image transfer roll and an image transfer belt.

6. A method of marking an image on a media substrate using an intermediate image transfer printing apparatus, the intermediate image transfer printing apparatus including a photoreceptor surface; an exposure station operatively associated with the photoreceptor surface; a developer system operatively associated with the photoreceptor surface; an intermediate image transfer surface operatively associated with the photoreceptor surface; and an image transfer nip operatively associated with the intermediate image transfer surface, the image transfer nip including a backup roll and a paper escort apparatus to engage a media sheet, and one or more of the backup roll, paper escort apparatus and the intermediate image transfer surface including a dielectric material, the method comprising:

a) forming an electrostatic image on the photoreceptor surface representative of an image to be marked on a media substrate using the exposure system;

b) developing the electrostatic image on the photoreceptor surface with toner material using the developer system to generate a developed image;

c) transferring the developed image from the photoreceptor surface to the intermediate image transfer surface;

d) advancing the developed image on the intermediate image transfer surface to the image transfer nip; and e) generating an electric field across the image transfer nip utilizing a constant current source operatively connected to the backup roll and the paper escort apparatus, whereby, the generated electric field transfers the developed image from the intermediate image transfer surface to a media sheet, wherein the backup roll includes a conductive material operatively connected to a ground, the backup roll includes the dielectric material and a charge neutralization system is operatively associated with the backup roll, step e) comprising:

e1) generating an electric field across the nip utilizing a constant current source operatively connected to the backup roll and the paper escort apparatus, whereby the generated electric field transfers the developed image from the intermediate image transfer surface to a media sheet; and e2) neutralizing the dielectric material using the charge neutralization system.

7. The method of marking an image on a media substrate according to claim 6, wherein the photoreceptor surface is a photoreceptor drum and the intermediate image transfer surface is a belt.

8. The method of marking an image on a media substrate according to claim 7, wherein the belt includes the dielectric material.

9. The method of marking an image on a media substrate according to claim 6, further comprising:

f) fusing the developed image transferred to the media substrate.

10. The method of marking an image on a media substrate according to claim 7, wherein the paper escort apparatus is one or more of an image transfer roll and an image transfer belt.

11. An intermediate image transfer marking apparatus comprising:

a photoreceptor surface;

an exposure station operatively associated with the photoreceptor surface;

a developer system operatively associated with the photoreceptor surface;

an intermediate image transfer surface operatively associated with the photoreceptor surface;

an image transfer nip operatively associated with the intermediate image transfer surface, the image transfer nip including a backup roll and a paper escort apparatus configured to engage a media sheet, and one or more of the backup roll, paper escort apparatus and intermediate image transfer surface including a dielectric material; and a controller operatively associated with the photoreceptor surface, the exposure station, the developer system, the intermediate image transfer surface and the image transfer nip, the controller configured to execute a process of marking an image on a media substrate using the intermediate image transfer marking apparatus, the process comprising:

a) forming an electrostatic image on the photoreceptor surface representative of an image to be marked on a media substrate using the exposure system;

b) developing the electrostatic image on the photoreceptor surface with toner material using the developer system to generate a developed image;

c) transferring the developed image from the photoreceptor surface to the intermediate image transfer surface;

d) advancing the developed image on the intermediate image transfer surface to the image transfer nip; and e) generating an electric field across the image transfer nip utilizing a constant current source operatively connected to the backup roll and the paper escort apparatus, wherein the paper escort apparatus includes a conductive material operatively connected to a ground, the paper escort apparatus includes the dielectric material, and a charge neutralization system is operatively associated with the paper escort apparatus, step e) comprising:

e1) generating an electric field across the nip utilizing a constant current source operatively connected to the backup roll and the paper escort apparatus;

whereby the generated electric field transfers the developed image from the intermediate image transfer surface to a media sheet; and e2) neutralizing the dielectric material using the charge neutralization system.

12. The intermediate image transfer marking apparatus according to claim 11, wherein the photoreceptor surface is one of a photoreceptor drum and a photoreceptor belt, and the intermediate image transfer surface is a belt.

13. The intermediate image transfer marking apparatus according to claim 12, wherein the belt includes the dielectric material.

14. The intermediate image transfer image marking apparatus according to claim 11, further comprising:

a fuser, and the process further comprises:

f) fusing the developed image transferred to the media substrate.

15. The intermediate image transfer marking apparatus according to claim 11, wherein the paper escort apparatus is one or more of an image transfer roll and an image transfer belt.

16. The intermediate image transfer marking apparatus according to claim 11, wherein the paper escort apparatus includes one of an OPC, a metal drum including a dielectric coating, and a conformable conductive foam including a dielectric coating.

17. The intermediate image transfer marking apparatus according to claim 11, wherein the paper escort apparatus includes one of a photoreceptor belt, and an image transfer belt with a dielectric layer.

18. The intermediate transfer image marking apparatus according to claim 11, wherein the charge neutralization system includes one of a photodischarge lamp, an AC coroton, an AC scorotron, and an AC BCR charge neutralization member.

19. An intermediate image transfer marking apparatus comprising:

a photoreceptor surface;

an exposure station operatively associated with the photoreceptor surface;

a developer system operatively associated with the photoreceptor surface;

an intermediate image transfer surface operatively associated with the photoreceptor surface;

an image transfer nip operatively associated with the intermediate image transfer surface, the image transfer nip including a backup roll and a paper escort apparatus configured to engage a media sheet, and one or more of the backup roll, paper escort apparatus and intermediate image transfer surface including a dielectric material; and a controller operatively associated with the photoreceptor surface, the exposure station, the developer system, the intermediate image transfer surface and the image transfer nip, the controller configured to execute a process of marking an image on a media substrate using the intermediate image transfer marking apparatus, the process comprising:

a) forming an electrostatic image on the photoreceptor surface representative of an image to be marked on a media substrate using the exposure system;

b) developing the electrostatic image on the photoreceptor surface with toner material using the developer system to generate a developed image;

c) transferring the developed image from the photoreceptor surface to the intermediate image transfer surface;

d) advancing the developed image on the intermediate image transfer surface to the image transfer nip; and e) generating an electric field across the image transfer nip utilizing a constant current source operatively connected to the backup roll and the paper escort apparatus, wherein the backup roll includes a conductive material operatively connected to a ground, the backup roll includes the dielectric material and a charge neutralization system is operatively associated with the backup roll, step e) comprising:

e1) generating an electric field across the nip utilizing a constant current source operatively connected to the backup roll and the paper escort apparatus, whereby the generated electric field transfers the developed image from the intermediate image transfer surface to a media sheet; and e2) neutralizing the dielectric material using the charge neutralization system.

20. The intermediate image transfer marking apparatus according to claim 19, wherein the paper escort apparatus is one of an ITR, and an ITR operatively associated with an ITB and the backup roll includes one of an OPC, a metal drum including a dielectric coating, and a conformable foam including a dielectric coating.

21. The intermediate image transfer marking apparatus according to claim 19, wherein the charge neutralization system includes one of a photodischarge, an AC coroton, an AC scorotron, and an AC BCR charge neutralization member.

22. The method of marking an image on a media substrate according to claim 19, wherein the backup roll includes a conductive material operatively connected to a ground, the backup roll includes the dielectric material and a charge neutralization system is operatively associated with the backup roll, step e) comprising:

e1) generating an electric field across the nip utilizing a constant current source operatively connected to the backup roll and the paper escort apparatus, whereby the generated electric field transfers the developed image from the intermediate image transfer surface to a media sheet; and e2) neutralizing the dielectric material using the charge neutralization system.

23. The method of marking an image on a media substrate according to claim 22, wherein the backup roll includes a conductive material operatively connected to a ground, the backup roll includes the dielectric material and a charge neutralization system is operatively associated with the backup roll, step e) comprising:

e1) generating an electric field across the nip utilizing a constant current source operatively connected to the backup roll and the paper escort apparatus, whereby the generated electric field transfers the developed image from the intermediate image transfer surface to a media sheet; and e2) neutralizing the dielectric material using the charge neutralization system.

24. The intermediate image transfer image marking apparatus according to claim 19, further comprising:

a fuser, and the process further comprises:

f) fusing the developed image transferred to the media substrate.

25. The intermediate image transfer marking apparatus according to claim 19, wherein the paper escort apparatus is one or more of an image transfer roll and an image transfer belt.

26. An intermediate image transfer markinq apparatus comprising:

a photoreceptor drum;

an exposure station operatively associated with the photoreceptor drum;

a developer system operatively associated with the photoreceptor drum;

an intermediate image transfer surface operatively associated with the photoreceptor drum;

an image transfer nip operatively associated with the intermediate image transfer surface, the image transfer nip including a backup roll and a paper escort apparatus configured to engage a media sheet, and one or more of the backup roll, paper escort apparatus and intermediate image transfer surface including a dielectric material;

a fuser; and a controller operatively associated with the photoreceptor drum, the developer system, the intermediate image transfer surface and the image transfer nip, the controller configured to execute a process of marking an image on a media substrate using the intermediate image transfer image marking apparatus, the process comprising:

a) forming an electrostatic image on the photoreceptor drum representative of an image to be marked on a media substrate using the exposure system;

b) developing the electrostatic image on the photoreceptor drum to generate a developed image using the developer system;

c) transferring the developed image from the photoreceptor drum to the intermediate image transfer surface;

d) advancing the developed image on the intermediate image transfer surface to the image transfer nip;

e) generating an electric field across the image transfer nip utilizing a constant current source operatively connected to the backup roll, the paper escort apparatus and the dielectric material, whereby the generated electric field transfers the developed image from the intermediate image transfer surface to a media sheet; and f) fusing the image transferred to the media sheet using the fuser, wherein the paper escort apparatus includes a conductive material operatively connected to a ground, the paper escort apparatus includes the dielectric material, and a charge neutralization system is operatively associated with the paper escort apparatus, step e) comprising:

e1) generating an electric field across the nip utilizing a constant current source operatively connected to the backup roll and the paper escort apparatus;

whereby the generated electric field transfers the developed image from the intermediate image transfer surface to a media sheet; and e2) neutralizing the dielectric material using the charge neutralization system.

27. The intermediate transfer image marking apparatus according to claim 26, wherein the paper escort apparatus is one or more of an image transfer roll, and an image transfer roll operatively associated with an image transfer belt.

28. The intermediate image transfer marking apparatus according to claim 26, wherein the paper escort apparatus includes one of an OPC, a metal drum with a dielectric coating and a conformable conductive foam with a dielectric coating.

29. The intermediate image transfer marking apparatus according to claim 26, wherein the paper escort apparatus includes one of a photoreceptor belt, and an image transfer belt with a dielectric layer.

30. The intermediate image transfer marking apparatus according to claim 26, wherein the charge neutralization system includes one of a photodischarge, an AC coroton, an AC scorotron and an AC BCR charge neutralization member.

31. The intermediate image transfer marking apparatus according to claim 26, wherein the intermediate transfer surface is a belt.

32. The intermediate image transfer marking apparatus according to claim 26, wherein the belt includes the dielectric material.

33. An intermediate image transfer marking apparatus comprising:

a photoreceptor drum;

an exposure station operatively associated with the photoreceptor drum;

a developer system operatively associated with the photoreceptor drum;

an intermediate image transfer surface operatively associated with the photoreceptor drum;

an imaqe transfer nip operatively associated with the intermediate image transfer surface, the image transfer nip including a backup roll and a paper escort apparatus configured to engage a media sheet, and one or more of the backup roll, paper escort apparatus and intermediate image transfer surface including a dielectric material;

a fuser; and a controller operatively associated with the photoreceptor drum, the developer system, the intermediate image transfer surface and the image transfer nip, the controller configured to execute a process of marking an image on a media substrate using the intermediate image transfer image marking apparatus, the process comprising:

a) forming an electrostatic image on the photoreceptor drum representative of an image to be marked on a media substrate using the exposure system;

b) developing the electrostatic image on the photoreceptor drum to generate a developed image using the developer system;

c) transferring the developed image from the photoreceptor drum to the intermediate image transfer surface;

d) advancing the developed image on the intermediate image transfer surface to the image transfer nip;

e) generating an electric field across the image transfer nip utilizing a constant current source operatively connected to the backup roll, the paper escort apparatus and the dielectric material, whereby the generated electric field transfers the developed image from the intermediate image transfer surface to a media sheet; and f) fusing the image transferred to the media sheet using the fuser, wherein the backup roll includes a conductive material operatively connected to a ground, the backup roll includes the dielectric material and a charge neutralization system is operatively associated with the backup roll, step e) comprising:

e1) generating an electric field across the nip utilizing a constant current source operatively connected to the backup roll and the paper escort apparatus, whereby the generated electric field transfers the developed image from the intermediate image transfer surface to a media sheet; and e2) neutralizing the dielectric material using the charge neutralization system.

34. The intermediate image transfer marking apparatus according to claim 33, wherein the paper escort apparatus is one of an ITR and an ITR operatively associated with an ITB, and the backup roll includes one of an OPC, a metal drum with a dielectric coating and a conformable foam with a dielectric coating.

35. The intermediate image transfer marking apparatus according to claim 33, wherein the charge neutralization system includes one of a photodischarge, an AC coroton, an AC scorotron and an AC BCR charge neutralization member.

36. The intermediate transfer image marking apparatus according to claim 28, wherein the paper escort apparatus is one or more of an image transfer roll, and an operatively associated with an image transfer belt.

37. The intermediate image transfer marking apparatus according to claim 33, wherein the intermediate transfer surface is a belt.

38. The intermediate image transfer marking apparatus according to claim 37, wherein the belt includes the dielectric material.

* * * * *